US005353709A

United States Patent [19]

Emmenegger et al.

[11] Patent Number: 5,353,709

[45] Date of Patent: Oct. 11, 1994

[54] METHOD FOR IMPROVING THE MECHANICAL STRESSABILITY OF AMMUNITION BODIES WITH SHAPED CHARGES

[75] Inventors: Anton Emmenegger; Ralph Eller, both of Altdorf, Switzerland

[73] Assignee: Schweizerische Eidgenossenschaft Vertreten Durch Die Eidg. Munitionsfabrik Altdorf Der Gruppe Fuer Ruestungsdienste, Altdorf, Switzerland

[21] Appl. No.: 925,074

[22] Filed: Aug. 5, 1992

[30] Foreign Application Priority Data

Aug. 16, 1991 [CH] Switzerland ..... 02426/91

[51] Int. Cl.[5] ..... F42B 1/02

[52] U.S. Cl. ..... 102/309; 102/307; 102/289; 102/291

[58] Field of Search ..... 102/289–291, 102/307, 309

[56] References Cited

U.S. PATENT DOCUMENTS

| | | | |
|---|---|---|---|
| 2,892,407 | 6/1959 | MacLeod | 102/24 |
| 3,034,393 | 5/1962 | Lieberman et al. | 86/1 |
| 3,636,881 | 1/1972 | Godfrey | 102/103 |
| 4,336,209 | 6/1982 | Glyden et al. | 264/3 R |
| 4,384,527 | 5/1983 | Bugiel et al. | 102/309 |
| 4,604,248 | 8/1986 | Dehm | 264/3.1 |
| 4,901,619 | 2/1990 | Sassmannshausen et al. | 86/20.12 |
| 4,961,382 | 10/1990 | Bai et al. | 102/476 |
| 5,115,707 | 5/1992 | Kutzli | 86/20.1 |

FOREIGN PATENT DOCUMENTS

| | | |
|---|---|---|
| 0166928 | 6/1984 | European Pat. Off. . |
| 0260419 | 7/1987 | European Pat. Off. . |
| 0431665 | 12/1989 | European Pat. Off. . |
| 2046372 | 3/1972 | Fed. Rep. of Germany . |
| 2155229 | 6/1973 | Fed. Rep. of Germany . |
| 2656310 | 12/1976 | Fed. Rep. of Germany . |
| 2553245 | 6/1977 | Fed. Rep. of Germany . |
| 3420544 | 12/1985 | Fed. Rep. of Germany . |
| 3420544A1 | 12/1985 | Fed. Rep. of Germany . |
| 72904 | 11/1949 | France . |

*Primary Examiner*—Peter A. Nelson

*Attorney, Agent, or Firm*—Schweitzer Cornman & Gross

[57] ABSTRACT

A method is described for improving the mechanical stressability of ammunition bodies, particularly shaped charges, which are highly accelerated and/or subjected to shock waves by coating the contacting portion of the cavity. In a first step of the method, the charge liner is coated on its outer surface and the case is coated on its inner surface with a styrene-containing copolymer; in a further step of the method, the explosive charge is cast or compressed in a known manner. The method finds use particularly for the production of tandem shaped charge projectiles.

14 Claims, 1 Drawing Sheet

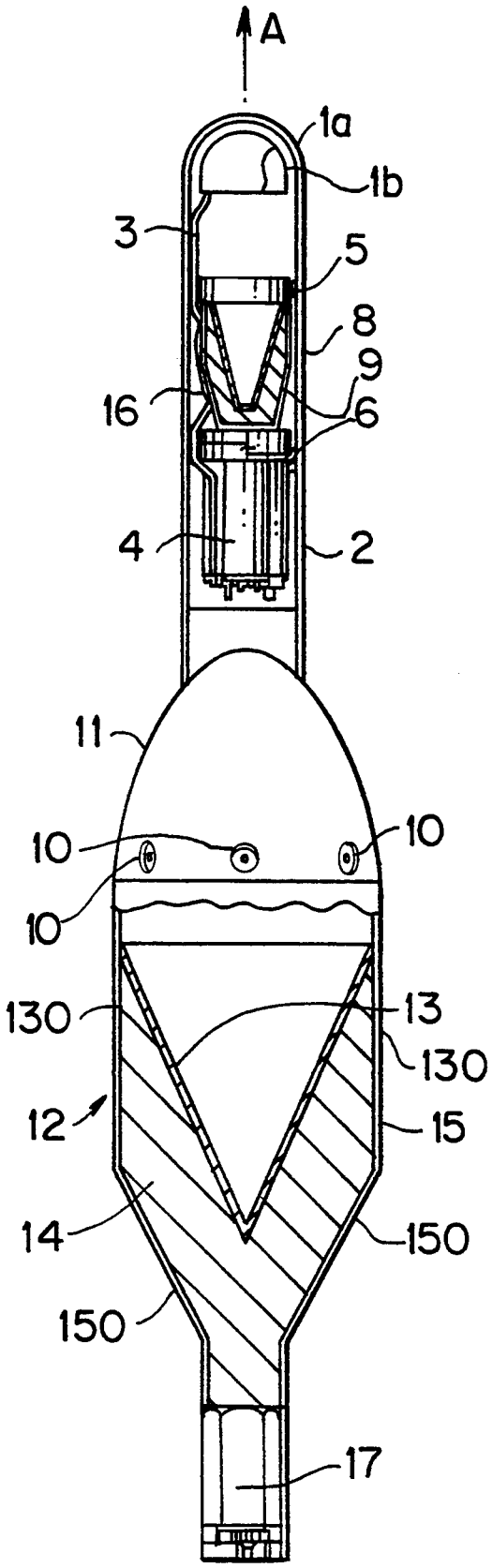
A
1a
1b
3
5
8
9
16
6
4
2
11
10
10
10
130
13
130
12
15
14
150
150
17

METHOD FOR IMPROVING THE MECHANICAL STRESSABILITY OF AMMUNITION BODIES WITH SHAPED CHARGES

FIELD OF THE INVENTION

The present invention relates to a method for improving the mechanical stressability of highly accelerated ammunition bodies, especially shaped cavity charges having a surface-treated metallic case and/or lining. The disclosure of Swiss priority application No. 02 426/91-3 filed Aug. 16 1991 is incorporated herein by reference.

BACKGROUND OF THE INVENTION

When ammunition bodies are used, particularly those with tandem shaped charges, the danger exists that the first, front cavity charge (also referred to as the "precursor charge"), upon being detonated, exerts an undesirable shock effect on the second, rear charge (the main charge). This can lead to interference with the formation or the symmetry of the jet or even to premature detonation of the main charge.

To eliminate in-bore explosions and/or premature detonations, thermal treatments of the ammunition bodies have been proposed. However, such solutions have been unable to eliminate the problem satisfactorily.

OBJECTS OF THE INVENTION

It is therefore an object of the invention to improve the mechanical stressability of ammunition bodies which are highly accelerated and/or subjected to shock waves, and to ensure the satisfactory detonation of such charges, and particularly tandem shaped charges, at the intended target.

SUMMARY OF THE INVENTION

The above objective of the invention is accomplished by coating the charge lining on its outer surface and coating the casing on its inner surface with an adhesive. The explosive charge is cast or compressed in the cavity between the case and the lining.

Due to the application of adhesive on such metallic component of the charge, adhesion to the explosive is increased, and the transfer to and development of undesirable shock effects on the charge is reduced. Premature detonations or so-called "sympathetic detonations" can therewith be prevented.

A particular advantage of the inventive method is that previous processing techniques for ammunition bodies and their charges, particularly the casting or compressing of explosives, do not have to be changed.

Advantageously, the metallic charge liner is coated with the adhesive by immersing the conical liner in an adhesive solution in a manner that only the outer surface, which comes into contact with the explosive, is wetted by the adhesive solution.

It is advisable and economically advantageous to spray the inner surface of the charge casing, which frequently has a concave shape, with the adhesive solution.

The adhesive solution can be applied by spraying a jet having a pre-defined amount of solution on the inner surface of the casing, as well as on the outer surface of the liner, while the two parts are rotating about their axis of rotation. This method is adaptable to automatic manufacturing processes.

The metallic parts of the shaped charge may be heated before the explosives are cast, in order to avoid fissures and stresses in the resulting shaped charge. The temperature is selected so that it is about 40% below the safety temperature of the explosive, that is, below the temperature at which the explosive tends to explode spontaneously. It is advisable to also heat the explosive up to a temperature which is above its melting point and below the safety temperature.

The adhesive solution consists of an adhesive which is compatible with the explosive. A styrene-containing copolymer lacquer is preferred. It is advantageous to dilute the semi-liquid or viscous adhesive with a suitable solvent, or to dissolve it in such a solvent, so that its application on the metallic surfaces can be best controlled. Preferred solvents are those which may be easily removed after application, such as toluene, xylene or butyl acetate. Suitable concentrations of the adhesive in such solvents are 30% by weight adhesive and 70% by weight of solvent. This concentration provides an optimum adhesive layer that is a few micrometers thick.

The method of the present invention is highly suitable for the production of tandem shaped charges, and ensures satisfactory jet formation against the target. The corresponding explosive charge may consist of a mixture of 70 to 80% by weight of octogen and 20 to 30% by weight of trinitrotoluene.

The inventive method is also suitable for the filling and casting of ammunition bodies with TNT and hexolire, which generally should show better adhesion between the wall parts and the adhesive.

BRIEF DESCRIPTION OF THE FIGURE

Illustrative embodiments of the invention are described in greater detail in the following detailed description in association with the annexed drawing, in which a warhead of a shaped charge projectile with a tandem shaped charge in accordance with the invention is shown diagrammatically.

DETAILED DESCRIPTION OF THE INVENTION

With reference to the Figure, the firing direction of a known shaped charge projectile is indicated by A. A double hood, formed of outer and inner half shells 1*a* and 1*b*, respectively, can be seen at the upper end. Such hood exerts a switching function at the target, in order to activate the ignition of the projectile. From the inner half shell 1*b*, a control line 3 leads to an ignition generator 4 below, with the appropriate safety elements as known. This assembly is within a snorkel 2, also known as a so-called "standoff tube", which is reinforced with supporting rings 5 and 6.

Between the supporting rings 5 and 6 is a first shaped charge 8, a so-called "precursor charge" This first shaped charge is affixed to the snorkel 2 through its case 9. A second hollow charge 12, the so-called main charge, is fastened to the ballistic double shell 11. The liner 13 is in the interior of the main charge, which is surrounded by the charge explosive 14, which is held by the case 15. An ignition generator with safety elements 17 is mounted to the case 15.

An adhesive layer 130 of the present invention is applied to the outside of the liner 13. A similar adhesive layer 150 is on the inside of the casing or case 15.

In manufacture of the projectile in accordance with the present invention, the metallic components of the shaped charge projectile are first degreased in standard fashion by a known procedure. The aluminum case 15 may then be chromalized in accordance with the US MIL-C-5541 standard; the liner 13, which is typically of copper, may also be protected in a known manner against corrosion, such as by use of the COBRATEC-TT-100 product of the Keyset Mackay Co. of Zurich.

After such surface treatments, an adhesive solution is applied to the metallic surfaces which are to come into contact with the explosive, typically the outer surface of the liner 13 and the inner surface of the case 15. Very good results have been achieved with a solution of 30% by weight of "Kleber 15" of the PROGA Co. of Grenchen, Switzerland, and 70% by weight of pure toluene. Kleber 15 has a low modulus of elasticity of about 3 $N/mm^2$ over a wide range of temperatures. The mechanical properties are advantageous; the adhesive has rubber elastic properties. The thermal-chemical compatibility is good, since Kleber 15 does not show any decomposition point depression.

The outer surface of the liner 13 may be immersed into the adhesive solution and subsequently dried at room temperature, preferably in a stream of warm air. After the toluene has evaporated, the adhesive layer 130 remains behind.

The inner surface of the case 15 may be filled with about 100 ml of the adhesive solution. The liquid may be swirled around in the case and then emptied out. The case is then dried at room temperature, again preferably, in a stream of warm air.

The thus-coated metal parts are then assembled and heated to, at most, 100° C. The explosive charge is also poured out in a known manner with octol in accordance with the US MIL-O-45445/B standard. Typically, the explosive charge is poured as a mobile melt at 100° C. into the appropriate cavities of the ammunition body.

The shaped charge is subsequently cooled to room temperature in a process lasting 2 to 3 days with intermittent vibration of the melt. At the start of the cooling phase, the main function of the vibration is to mix the charge homogeneously; at the same time, vibration eliminates any air bubbles that may have been entrapped. After cooling, the shaped charge projectile is further assembled in a customary manner.

A similar procedure may be performed with respect to the precursor charge.

Comparison investigations of the tensile strength of shaped charge projectiles which have and have not been coated pursuant to the invention, revealed tensile strengths of 300 N and 1,000 N without the coating. With the coating, tensile strengths of 3,000 N and 4,000 N were measured. These values are higher than the tensile strength of the explosive.

Tests of the performance on comparison targets of the inventive shaped charges coated with Kleber 15 show a 50% increase in residual performance; for other targets, the residual performance averages even 80% higher.

The method of the present invention for improving the mechanical stressability is also suitable for other cast or compressed explosive charges and different explosives, particularly those for armor-piercing ammunition and artillery and mortar shells.

We claim:

1. A method for the improvement of the mechanical stressability of tandem shaped ammunition bodies having at least one cavity charge mounted between a metallic case and a lining, which are subject to high acceleration and/or are subjected to shock waves, comprising coating at least one of the outer surfaces of the lining and the inner surface of the case with a styrene-containing copolymer lacquer adhesive to a coating thickness of 1 to 100 μm and a broad temperature range modulus of elasticity of about 3 $N/mm^2$; allowing the adhesive to dry; and placing an explosive charge into the cavity between the case and the lining.

2. The method of claim 1, wherein said explosive charge placing step is performed by pouring a liquid explosive charge into the cavity.

3. The method of claim 1, wherein said placing step is performed by compressing an explosive charge into the cavity

4. The method of claim 1, wherein said liner coating step is performed by immersing the liner in an adhesive solution.

5. The method of claim 1, wherein said case coating step is performed by spraying.

6. The method of claim 1, wherein said liner and case coating steps comprise the steps of assembling said liner and case together and then coating the outer surface of the liner and the inner surface of the case simultaneously with an adhesive solution.

7. The method of claim 1, wherein at least one of said liners and said case is rotated about its axis of rotation during the coating step.

8. The method of claim 1, further comprising the steps, prior to said explosive placing step, of fixing said liner to said case of the ammunition body; heating the resulting structure to a temperature above room temperature and below 40% of the safety temperature specific for the explosive; and heating the explosive charge to a temperature, which is above the melting point and below 40% of the safety temperature.

9. The method of claim 1, wherein said coating step is performed to yield a coating thickness of 1 to 100 micrometers.

10. The method of claim 9, wherein the adhesive solution is chosen from the group consisting of 5 to 50% by weight of adhesive and 50 to 95% by weight of toluene; 5 to 50% by weight of adhesive and 50 to 95% by weight of xylene; and 5 to 50% by weight of adhesive and 50 to 95% by weight of butyl acetate.

11. The method of claim 10, wherein the adhesive solution contains 30% by weight of adhesive and 70% by weight of toluene.

12. The method of claim 10, wherein the adhesive solution contains 30% by weight of adhesive and 70% by weight of xylene.

13. The method of claim 10, wherein the adhesive solution contains 30% by weight of adhesive and 70% by weight of butyl acetate.

14. The method of claim 1, wherein the explosive charge consists of a mixture of 70 to 80% by weight of octogen and 20 to 30% by weight of trinitrotoluene and is cast with the metallic components.

* * * * *